US005468131A

United States Patent [19]

Blume et al.

[11] Patent Number: 5,468,131

[45] Date of Patent: Nov. 21, 1995

[54] METHOD FOR COOLING THE SHAFT OF A GEAR PUMP ROTOR, A GEAR PUMP ROTOR, AND A GEAR PUMP COMPRISING SUCH A ROTOR

[75] Inventors: Peter Blume, Zürich; Roger Stehr, Bülach, both of Switzerland

[73] Assignee: MAAG Pump Systems AG, Zurich, Switzerland

[21] Appl. No.: 390,018

[22] Filed: Feb. 17, 1995

[30] Foreign Application Priority Data

Feb. 17, 1994 [EP] European Pat. Off. ..... 94102363

[51] Int. Cl.[6] ..... F01C 21/06

[52] U.S. Cl. ..... 418/94; 418/1; 418/206

[58] Field of Search ..... 418/1, 94, 206–206.1, 418/206.3

[56] References Cited

U.S. PATENT DOCUMENTS 4,073,607 2/1978 Webb et al. ..... 418/94
4,850,827 7/1989 Eiermann ..... 418/94
5,292,237 3/1994 Orimo et al. ..... 418/94

FOREIGN PATENT DOCUMENTS 4211516 7/1993 Germany .
324687 2/1930 United Kingdom ..... 418/94

*Primary Examiner*—Charles Freay
*Attorney, Agent, or Firm*—Evenson McKeown Edwards & Lenahan

[57] ABSTRACT

A gear pump rotor assembly is disclosed. In order to prevent that the gear toothing is cooled in an unreliable manner, radial heat flow is reduced in the toothing area of the shaft, preferably by means of an insulation air chamber or other insulated section, with respect to the heat flow in other shaft areas to be cooled.

14 Claims, 2 Drawing Sheets

METHOD FOR COOLING THE SHAFT OF A GEAR PUMP ROTOR, A GEAR PUMP ROTOR, AND A GEAR PUMP COMPRISING SUCH A ROTOR

BACKGROUND AND SUMMARY OF THE INVENTION

The present invention relates to a system and method for cooling the shaft of a gear pump rotor in which a cooling medium is supplied axially through the shaft.

Because of the rheological characteristics of the lubricating medium, particularly when a conveying medium is used as a lubricating medium of slide bearings of the rotors, it is expedient in many applications of gear pumps to provide a shaft cooling or a lubricating medium cooling in order to dissipate the heat generated in the bearings, particularly in the slide bearings. As a result, a lower bearing temperature is achieved.

Normally, a shaft cooling system has an extremely simple construction. As illustrated in FIG. 1, which is a simplified axial sectional view of a known gear pump rotor 1, the shaft 3 has an axial bore 5 which passes through both bearing areas on the projecting shaft sections 7 as well as the shaft area $7_v$ in the toothing area. In the following, the toothing area $7_v$ is that area of the rotor shaft which is situated radially under the toothing irrespective of whether the gear wheel and the shaft are constructed as one part or as multiple parts.

A deflecting tube 11 projects into the axial bore 5, almost to the one-sided bore end 9. By way of a rotary sealing connection which is not shown, the cooling medium is fed to the deflecting tube 11, flows through this tube in an axial manner, is radially deflected at the end of the tube 11 in order to axially flow back in the countercurrent or vice versa. According to the preceding sign of the temperature difference, the cooling medium absorbs heat on its flow path or conveys heat. Reference is made in this respect to German Patent Document DE-A- 42 11 516.

A significant disadvantage of this cooling approach is the fact that, except for the cooling medium temperature which rises along the length of the bore and except for the different radial heat currents which normally flow out of the areas of the bearing and toothing areas, the shaft 7, $7_v$ is cooled without any differences. This may result in a cooling effect in the area of the toothing 13 which results in an undesirably extensive lowering of the temperature level in the tooth base.

It is an object of the present invention to eliminate this disadvantage.

This object is achieved according to the invention by means of a cooling method of the initially mentioned type, wherein a lower heat conduction to the cooling medium per axial dimension unit is established in a toothed area of the shaft than in other shaft areas to be cooled with respect to identical cylinder surfaces on the toothed and other shaft areas.

As the result of the fact that according to the invention, a lower heat conduction to the cooling medium per axial dimension unit in the toothed area of the shaft is provided, with a view to the same cylinder surfaces, than in the other shaft areas to be cooled, particularly the bearing areas, is now established, it is achieved that the above-mentioned disadvantageous cooling of the toothing is considerably reduced without any influence on the desired cooling effect, particularly in the bearing areas.

According to especially preferred embodiments, the advantageous results are achieved in a preferable manner in that a gas insulation, particularly an air insulation, is established in the toothing area $7_v$, and/or a solid-body insulation, and/or the cooling medium contact surface in the toothing area per axial dimension unit is reduced in comparison to the above-mentioned contact surface on shaft areas which are intended to be cooled.

With respect to a gear pump rotor of the initially mentioned type, the object on which the present invention is based is achieved by a construction with reduced cooling in the gear tooth areas.

Certain preferred embodiments of the gear pump rotor according to the invention include air insulation sections near the toothed area. Other embodiments include solid insulation sections near the toothed area. Yet other embodiments include a shaft and cooling tube configuration with reduced heat conduction area in the area of the gear toothing.

Other objects, advantages and novel features of the present invention will become apparent from the following detailed description of the invention when considered in conjunction with the accompanying drawings.

DETAILED DESCRIPTION OF THE DRAWINGS

Figure 1:
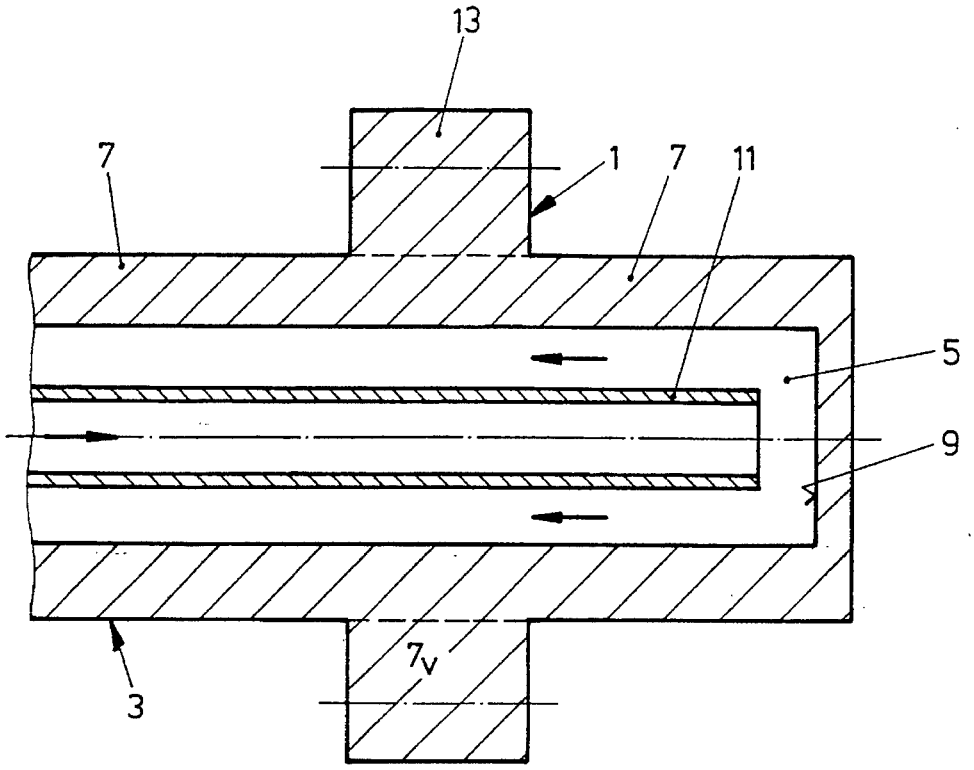
FIG. 1 PRIOR ART
FIG. 1 is a view of a known gear pump shaft cooling system.
Figure 2:
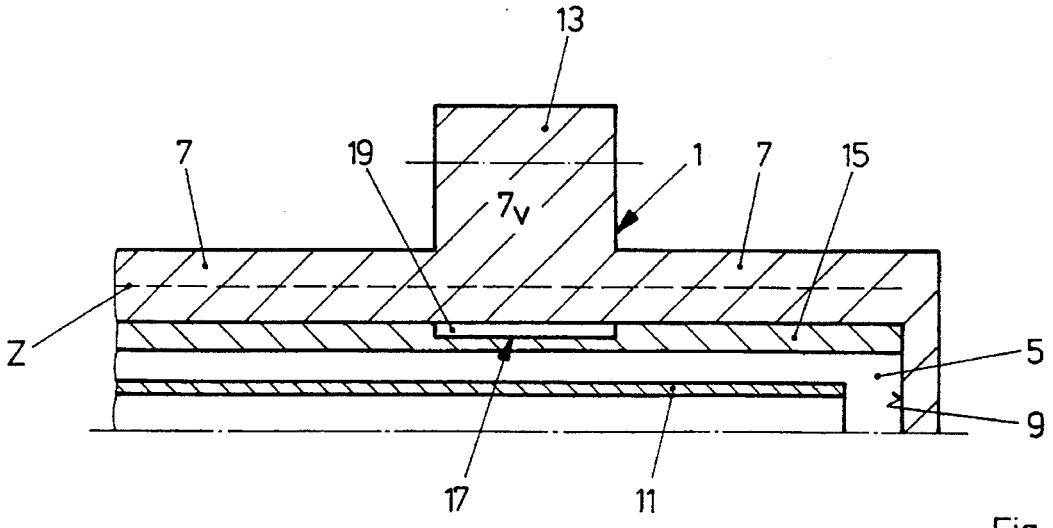
FIG. 2 is a view of a cut-out in a representation which is analogous to that of FIG. 1 of a first embodiment of a gear pump rotor shaft assembly according to the invention for the implementation of the method according to the invention in a first variant.

In FIG. 2, in which as well as in the following figures, the same reference numbers as in FIG. 1 are selected for the same parts, a jacket tube 15 is fitted into the rotor shaft bore 5, which jacket tube 15 rests on the wall of the bore 5, particularly on shaft areas to be cooled by means of its outer wall, ensuring a good heat transmission. The outside diameter of the jacket tube 15 is reduced in the toothing area $7_v$, whereby an annular groove 17 is formed in this outer wall. Together with the wall of the bore 5, this groove 17 forms an annular air chamber 19 which ensures a significantly lower heat conduction per axial dimension unit between the shaft and the cooling medium in the toothing area $7_v$ than on areas—viewed onto the same cylinder surfaces Z—one of which being entered as an example in FIG. 2.

Figure 3:
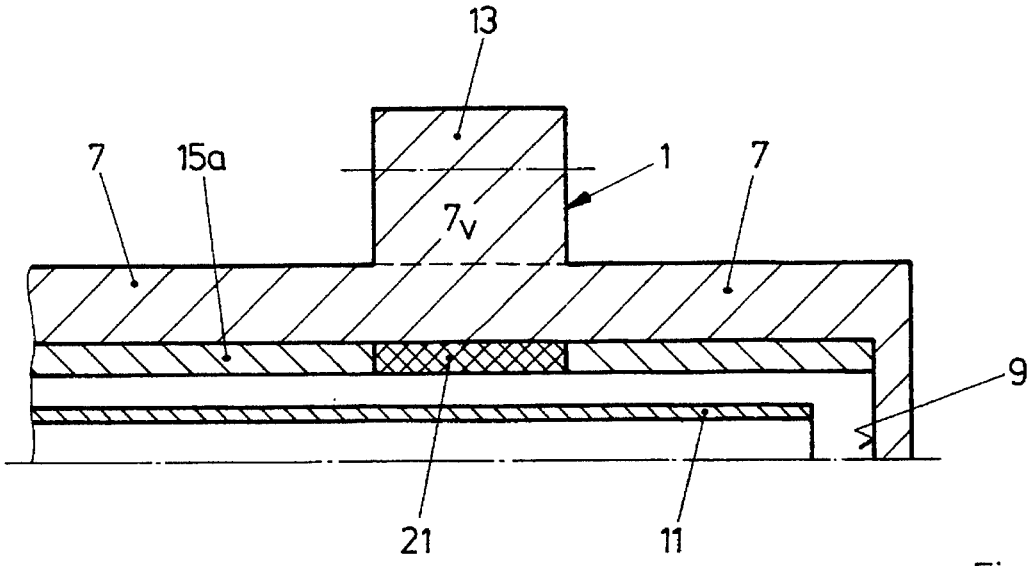
FIG. 3 is a representation which is analogous to FIG. 2 of a rotor according to the invention as a second variant or of a second variant for implementing the method according to the invention.

According to FIG. 3 of the invention, the above-mentioned heat conduction is reduced in the toothing area $7_v$ because of the fact that a solid-body insulator 21 is provided on a jacket tube **15*a*** in the toothing area $7_v$, whether—as illustrated—by means of the implementation of a jacket tube wall section made of a temperature-resistant insulation material or by means of an inner and/or outer wall coating of the jacket tube with such a material.

Figure 4:
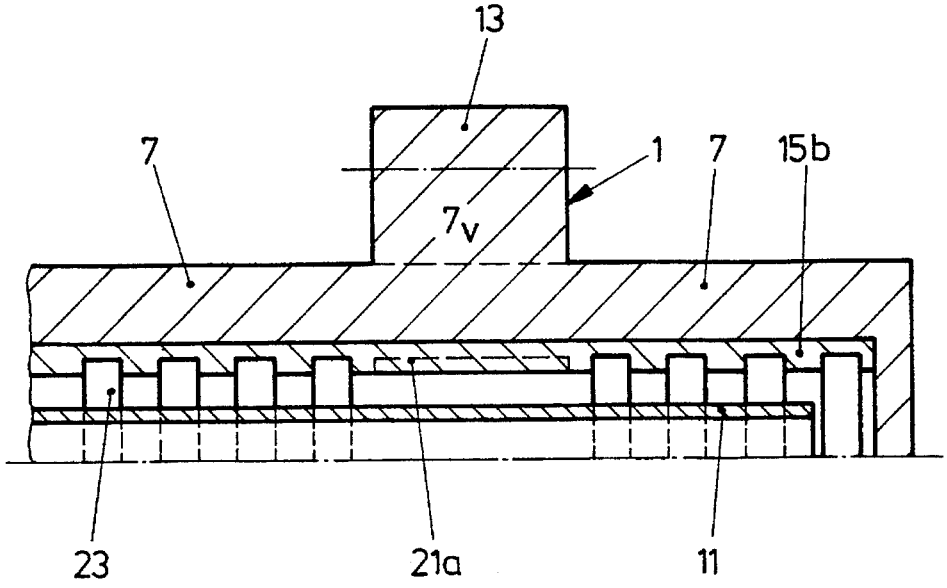
FIG. 4 is a view of a third variant of the gear pump rotor according to the invention or of the method according to the invention.

In the case of the variant according to FIG. 4, the surface, for example, of a jacket tube **15*b* is enlarged in the shaft areas 7 to be cooled per axial dimension unit, for example, by providing a grooving pattern 23 in these sections, in contrast to the construction of the inner surface of the jacket tube as a smooth cylinder surface in the toothing area $7_v$. As clearly illustrated in FIG. 4 and as indicated by an interrupted line at reference number 21***a*, it is easily possible to combine the providing of enlarged contact surfaces toward the cooling medium on shaft areas to be cooled with the providing of a thermal solid-body insulator 21*a* in the toothing area, and possibly even, as an alternative or in addition, reduce the outside diameter of the jacket tube 15*b* according to the construction of FIG. 2 in order to keep the cooling in the toothing area optimally low.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Method for cooling a shaft of a gear pump rotor in which a cooling medium is driven axially through the shaft, wherein a lower heat conduction to the cooling medium per axial dimension unit is established in a toothed area of the shaft than in other shaft areas to be cooled.

2. Method according to claim 1, wherein the lower heat conduction is achieved by providing one of a gas insulation, a solid-body insulation, and a reduction of the cooling-medium contact surface.

3. Method according to claim 1, wherein the lower heat conduction is achieved by providing an annular air insulation pocket along the toothed area of the shaft.

4. Method according to claim 1, wherein the lower heat conduction is achieved by providing a solid-body insulation section along the toothed area of the shaft.

5. Method according to claim 1, wherein the lower heat conduction is achieved by providing a section along the toothed area of the shaft with a reduced cooling medium contact area.

6. Gear pump rotor shaft assembly comprising a toothed area, a bearing shaft projecting axially with respect to the toothed area, and an axial duct arrangement for a cooling medium which extends through the toothed area and the bearing shaft, wherein the toothed area has a lower radial heat conduction per axial dimension unit of the shaft than said bearing shaft areas to be cooled.

7. Gear pump rotor shaft assembly according to claim 6, wherein the duct arrangement surface area per axial dimension mentioned unit in the toothed area is smaller than it is in bearing shaft areas to be cooled.

8. Gear pump rotor assembly according to claim 6, wherein an annular gas chamber is provided in the toothed area, which gas chamber is implemented by a tube which extends axially into said axial duct arrangement and has an outer groove in the toothed area.

9. Gear pump rotor assembly according to claim 7, wherein an annular gas chamber is provided in the toothed area, which gas chamber is implemented by a tube which extends axially into said axial duct arrangement and has an outer groove in the toothed area.

10. Gear pump rotor assembly according to claim 6, wherein an annular insert is provided in the toothed area, the radial heat conductivity of said annular insert being less than the heat conductivity of a corresponding ring provided in the bearing shaft sections to be cooled.

11. A gear pump rotor shaft assembly according to claim 7, wherein an annular insert is provided in the toothed area, the radial heat conductivity of said annular insert being less than the heat conductivity of a corresponding ring provided in the bearing shaft sections to be cooled.

12. A gear pump rotor assembly according to claim 8, wherein an annular insert is provided in the toothed area, the radial heat conductivity of said annular insert being less than the heat conductivity of a corresponding ring provided in the bearing shaft sections to be cooled.

13. A gear pump rotor assembly according to claim 9, wherein an annular insert is provided in the toothed area, the radial heat conductivity of said annular insert being less than the heat conductivity of a corresponding ring provided in the bearing shaft sections to be cooled.

14. A gear pump rotor assembly according to claim 6, comprising a second rotor shaft having a toothed section inter engageable with the toothed section of the first mentioned rotor shaft.

* * * * *